United States Patent [19]

Kawamura

[11] Patent Number: 4,711,087

[45] Date of Patent: Dec. 8, 1987

[54] EMISSIONS FILTER REGENERATION SYSTEM

[75] Inventor: Hideo Kawamura, Kanagawa, Japan

[73] Assignee: Isuzu Motors, Ltd., Japan

[21] Appl. No.: 877,493

[22] Filed: Jun. 23, 1986

[30] Foreign Application Priority Data

Jun. 26, 1985 [JP] Japan ..... 60-137838

[51] Int. Cl.[4] ..... F01N 3/02

[52] U.S. Cl. ..... 60/286; 60/303

[58] Field of Search ..... 60/286, 303, 311

[56] References Cited

U.S. PATENT DOCUMENTS 4,462,208 7/1984 Hicks ..... 60/286

4,566,271 1/1986 French ..... 60/286

4,610,138 9/1986 Shinzawa ..... 60/286

*Primary Examiner*—Douglas Hart

*Attorney, Agent, or Firm*—John E. Toupal; Harold G. Jarcho

[57] ABSTRACT

An emissions filter regeneration system including a particulate matter filter having an inlet connected by an exhaust pipe to an exhaust manifold of an engine, a pressure sensor disposed to sense the pressure at the inlet of the filter, a combustion chamber having an outlet opening disposed to discharge gases into the inlet, a fuel supply means for introducing fuel into the combustion chamber, an air supply means for introducing air into the combustion chamber, and an igniter for igniting a fuel and air mixture in the combustion chamber. Also included is a control means for activating the fuel supply means, the air supply means, and the igniter in response to sensing by the pressure sensor of a pressure above a predetermined value.

7 Claims, 3 Drawing Figures

EMISSIONS FILTER REGENERATION SYSTEM

BACKGROUND OF THE INVENTION

The present invention relates generally to a system for regenerating emission filters and, more particularly, to such a system for use in a Diesel engine.

Particulate matter such as carbon are contained in the exhaust gases of a Diesel engine, and removal of these particulates typically is accomplished by a particulate filter disposed in an exhaust pipe. Such a particulate filter is formed, for example, from ceramics formed with a number of slots arranged to collect the particulates as exhaust gases flow through in a circuitous fashion. After an extended period of use, conventional particulate filter become clogged and require regeneration.

In the past, there has been proposed a filter regenerating device having an electric heater for burning particulate matter at the inlet of the particulate filter. This prior art device, however, consumes substantial electrical power and can cause discharge of power source batteries.

An improved regeneration system is disclosed in Japanese Patent Application, Laid-Open No. 128912/84. In that system a combustor is arranged at the inlet of a particulate filter, and generates high temperature combustion gases for burning the particulates. Fuel is supplied to the combustor by an injection device and is mixed with air for combustion. However, for fuels such as light oil or gasoline poor in volatility, vaporization is not promoted by mere spray mixing with air so that the fuel often is supplied to the combustor in the form of droplets. Consequently, combustion produces smoke of high concentration in the combustor, further contaminating the particulate filter. To enhance the firing property of fuel in the combustor a back-flow type vaporization cylinder is employed to utilize fully the heat of exhaust gases. However, the vaporization cylinder requires the energy of hot exhaust gases produced during high load operation of the engine, and the particulate filter is not regenerated during low load engine operation.

In the above described system, the combustor is operated only when two conditions are met; i.e., when the change rate of pressure at the inlet is below a first predetermined value, and when the pressure at the inlet side is above a second predetermined value. Therefore, during operation attended by frequent acceleration and deceleration experienced in hilly terrain, the combustion state in the engines deteriorates resulting in an increase in exhaust gases and operation of the regeneration combustor is intermittent. Accordingly, the particulate filter cannot be regenerated properly and becomes clogged.

The object of the present invention, therefore, is to provide an improved system for regenerating a particulate filter in a Diesel engine.

SUMMARY OF THE INVENTION

The invention is an emissions filter regeneration system including a particulate matter filter having an inlet connected by an exhaust pipe to an exhaust manifold of an engine, a pressure sensor disposed to sense the pressure at the inlet of the filter, a combustion chamber having an outlet opening disposed to discharge gases into the inlet, a fuel supply means for introducing fuel into the combustion chamber, an air supply means for introducing air into the combustion chamber, and an igniter for igniting a fuel and air mixture in the combustion chamber. Also included is a control means for activating the fuel supply means, the air supply means, and the igniter in response to sensing by the pressure sensor of a pressure above a predetermined value. This simple arrangement eliminates problems inherent in prior systems by producing regeneration during a wider range of engine operating conditions.

According to one feature of the invention, the system also includes a temperature sensor disposed to sense the temperature of the discharged gases, and the control means deactivates the igniter means in response to sensing by the temperature sensor of temperatures above a given value. The temperature sensor deactivates the igniter when combustion in the combustion chamber is insured.

According to other features of the invention, the system includes a vaporization means disposed in the combustion chamber and comprising an electrical heater embedded in a flow distribution plate. The vaporization means vaporizes fuel injected into the combustion chamber so as to promote complete combustion thereof.

According to yet another feature of the invention, the combustion chamber comprises a cylindrical portion disposed in the exhaust pipe, and the air supply means comprises an annular air chamber surrounding the combustion chamber and supplying air thereto. The air chamber also is disposed in the exhaust pipe so as to produce heating of air by the exhaust gases therein.

According to still another feature, the invention includes a revolution sensor for sensing the operating revolutions of the engine, and the control means controls the fuel supply means, the air supply means and the igniter in response to outputs from both the pressure sensor and the revolution sensor. Responding to both inlet pressure and engine r.p.m.s improves the performance of the system.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
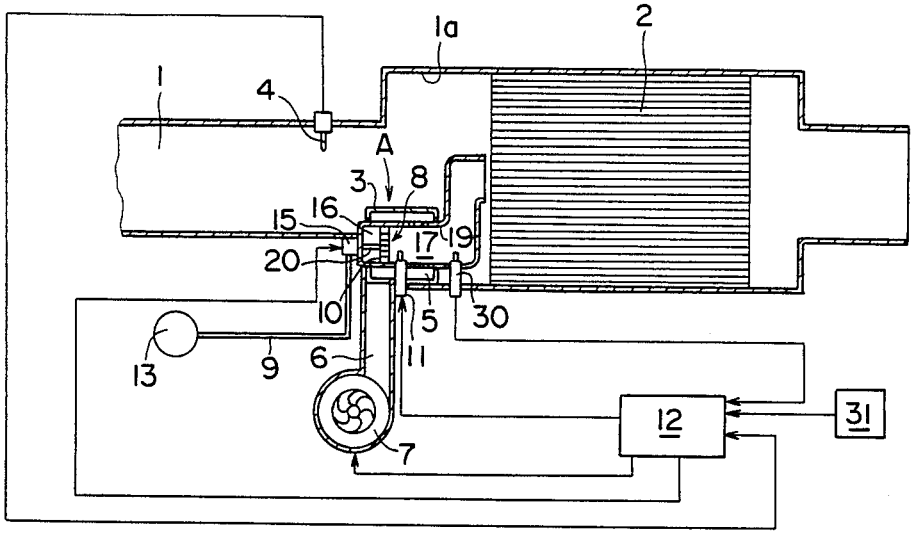
FIG. 1 is a schematic sectional view of a system for regenerating a particulate filter according to the present invention.

The present invention is illustrated schematically in FIG. 1 in which an exhaust pipe 1 is connected between an exhaust manifold (not shown) of a Diesel engine and a particulate filter 2. The filter 2 has a plurality of slots formed from ceramics and is retained in a housing 1*a* whose outside diameter is enlarged. Disposed within the pipe 1 and the housing 1*a*, respectively, at the inlet of the particulate filter 2 are a pressure sensor 4 and a combustor A.

Included in the combustor A, is a combustion cylinder 19 and a cylindrical housing 3 that surrounds the cylinder 19 and forms an annular air chamber 5. Outside air is introduced into the air chamber 5 by a blower 7 through an air intake duct 6. One end of the combustion cylinder 19 is closed and retains a fuel vaporization device 8 including a fuel flow distribution plate 10 having a number of holes formed from ceramics or the like. The plate 10 divides the combustion cylinder 19 into a combustion chamber 17 and a vaporization chamber 16. Fuel is supplied to the vaporization chamber 16 by a fuel pipe 20 having a jet and supported between the end wall of the combustion cylinder 19 and the apertured distribution plate 10. A fuel valve 15 is connected to an outer end of the fuel pipe 20 and to a fuel tank 13 by a fuel supply pipe 9. Fuel is heated in the vaporization device 8 by a heating coil embedded in the apertured distribution plate 10.

Either a firing or a spark ignition plug 11 extends through the air chamber 5 and is disposed in the combustion chamber 17. Air in the air chamber 5 is preheated by the exhaust gases in the exhaust pipe 1 and is supplied to the vaporization chamber 16 and the combustion chamber 17 through air ports in the combustion cylinder 19. An outlet end of the combustion cylinder 19 opens adjacent to the center of the inlet to the particulate filter 2. Mounted internally of the combustion cylinder 19 is a temperature sensor 30 that discriminates as to whether or not fuel is fired within the chamber 17. A sensor 31 detects the number of revolutions of the Diesel engine (not shown) connected to the exhaust pipe 1.

The operation of the combustor A is controlled by a control device 12 that receives input signals from the pressure sensor 4, the revolution sensor 31 and the temperature sensor 30. Outputs from the control device 12 are applied to the blower 7, the plug 11, the heating coil in the apertured distribution plate 10 and the fuel valve 15. The control device 12 is composed, for example, of a microcomputer, and a signal from the pressure sensor 4 is applied as a digital signal to the control device 12 through an A/D converter (not shown).

OPERATION

Pressure at the inlet of the particulate filter 2 is always detected by the pressure sensor 4, and an output signal indicative thereof is fed to the control device 12. The signal value increases proportional to the inlet pressure, and when this signal value becomes greater than a reference value Po, the control device 12 initially energizes the ignition plug 11 and the heater embedded in the plate 10 to prepare the combustor A for operation. Subsequently, the control device 12 activates the blower 7 and the valve 15. Energization of the blower 7 causes outside air to be fed from the air intake duct 6 into the air chamber 5. Preheating of the outside air is provided by the exhaust gases passing through the pipe 1 outside the housing 3. The air then is supplied from the air chamber 5 into the vaporization chamber 16 and combustion chamber 17, respectively, through air ports in the combustion cylinder 19. Also, opening of the valve 15 causes fuel in the fuel tank 13 to flow through the fuel supply pipe 9 and the fuel pipe 20 of the fuel vaporization device 8. The supplied fuel is discharged by a jet into the vaporization chamber 16, where it is mixed with air and fed into the combustion chamber 17 through the holes in the apertured distribution plate 10. Thus, a mixture of fuel and air is fed into the combustion chamber 17, and when heated to a firing temperature by the firing plug 11, combustion occurs. Resultant combustion gases pass through the combustion cylinder 19 and enter and regenerate the particulate filter 2 by burning the particulates collected therein.

When the particulate filter 2 is cleared of particulate matter, the pressure at the inlet thereof is reduced and, therefore, the detected signal value of the pressure sensor 4 decreases. At a value below Po, the control device deenergizes the blower 7, the ignition plug 11, the fuel valve 15 and the heating coil in the apertured distribution plate 10 to thereby terminate operation of the combustion A.

Figure 2:
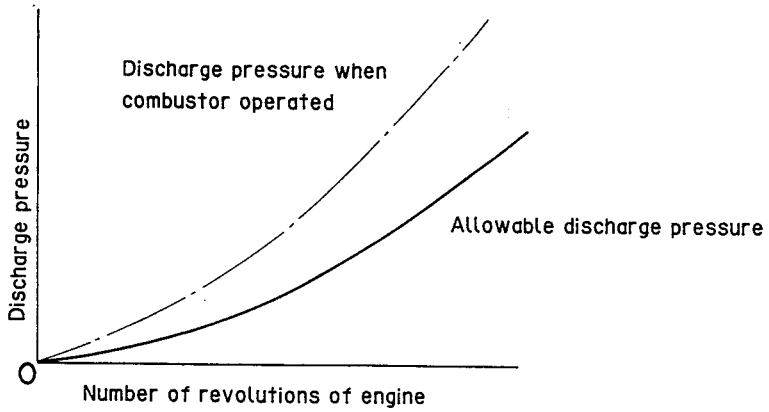
FIG. 2 is a schematic diagram illustrating operation of the system.

The allowable discharge pressure Po(reference level) of the combustor A at the inlet of the particulate filter 2 is determined by the control device 12 as shown in FIG. 2. Thus, the inlet pressure during regeneration is increased by the output of the combustor A but when the particulates are removed from the filter 2, the pressure decreases to a level below the allowable pressure.

Figure 3:
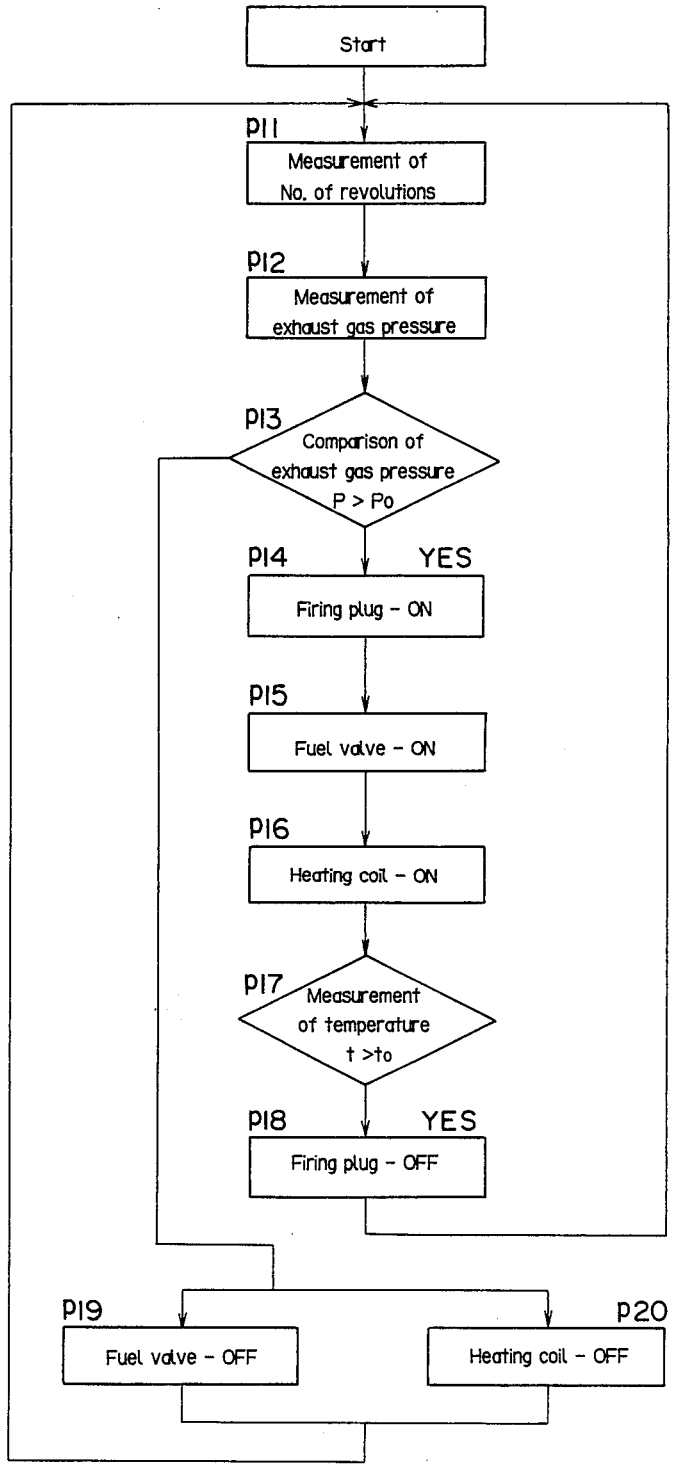
FIG. 3 is a flow sheet representing a software program for a microcomputer in the system.

FIG. 3 is a flow diagram showing the software program for a microcomputer in the control device 12. In step p11, the rate of revolutions of the engine is read, and a reference level Po corresponding thereto is determined from the control map (FIG. 2) stored in a ROM of the microcomputer. In step p12, the detected pressure P of the pressure sensor 4 at the inlet of the particulate filter 2 is read. In step p13, the detected pressure P is compared to the determined reference level Po. If the detected inlet pressure P is less than the reference level Po, the control device proceeds to step p19 and the fuel valve 15 is closed. At the same time, in step p20, the heating coil in the flow adjusting plate 10, the ignition plug 11 and the blower 7 are in a de-energized state.

If in step p13, the detected inlet pressure P exceeds the reference level Po, the control device 12 proceeds to step p14 where the ignition plug 11 is energized. Subsequently, in step p15, the fuel valve 15 is opened; in step p16, the heating coil in the flow adjusting plate 10 is energized; and instep p17, the signal value t of the temperature sensor 30 is compared to a reference value $t_o$. If the temperature t in the combustion chamber 17 is greater than the reference value $t_o$ a determination is made that the fuel was fired and in step p18, energization to the firing plug 11 is terminated.

Thus, in the present invention, outside air is taken in to insure complete burning of the fuel in the combustor 17 and the hot combustion gases are fed to the particulate filter 2 whereby the collected particulates are burned and removed. In the fuel vaporization portion 8 of the combustor, a heating coil embedded in the flow adjusting plate 10 produces complete vaporization of the fuel and ignition is positively achieved by the firing plug 11.

Obviously, many modifications and variations of the present invention are possible in light of the above teachings. It is to be understood, therefore, that the invention can be practiced otherwise than as specifically described.

What is claimed:

1. An emissions filter regeneration system comprising:

a particulate matter filter having an inlet connected by an exhaust pipe to an exhaust manifold of an engine;

a pressure sensor disposed to sense the pressure at said inlet of said filter;

a cylindrical combustion chamber having an outlet opening disposed to discharge gases into said inlet;

a cylindrical vaporization chamber axially aligned with and separated from said combustion chamber by an apertured fuel distribution plate;

fuel supply means for introducing fuel into said vaporization chamber;

air supply means for introducing air into said combustion chamber, said air supply means comprising a cylindrical member defining an annular air chamber surrounding said combustion chamber and communicating therewith through openings therein;

ignition means for igniting a fuel and air mixture in said combustion chamber;

an electric heater disposed in said plate to vaporize fuel transmitted from said vaporization chamber to said combustion chamber;

a revolution sensor for sensing the revolution rate of the engine; and control means for activating said fuel supply means, said air supply means, and said ignition means in response to sensing by said pressure sensor of a pressure at said inlet above a selected predetermined value determined by the revolution rate sensed by said revolution sensor.

2. A system according to claim 1 including a temperature sensor disposed to sense the temperature of said discharged gases, and wherein said control means deactivates said ignition means in response to sensing by said temperature sensor of temperatures above a given value.

3. A system according to claim 1 wherein said ignition means comprises an ignition plug, said air supply means comprises a blower, and said control means comprises a computer.

4. A system according to claim 3 wherein said combustion chamber is disposed in said exhaust pipe, said air chamber being disposed in said exhaust pipe so as to produce heating of said air by exhaust gases therein.

5. A system according to claim 1 wherein said control means activates said ignition means prior to activation of said fuel supply means.

6. A system according to claim 5 including a temperature sensor disposed to sense the temperature of said discharged gases, and wherein said control means deactivates said ignition means in response to sensing by said temperature sensor of temperatures above a given value.

7. A system according to claim 1 wherein the engine is a Diesel engine.

* * * * *